US005914024A

United States Patent [19]

Schuh et al.

[11] Patent Number: 5,914,024

[45] Date of Patent: Jun. 22, 1999

[54] METHOD FOR CLEANING OF ALUMINUM OXIDE POWDERS

[75] Inventors: Lothar Schuh, Plankstadt; Helge Jansen, Friedland, both of Germany

[73] Assignee: ABB Flaekt AB, Stockholm, Sweden

[21] Appl. No.: 08/881,219

[22] Filed: Jun. 24, 1997

Related U.S. Application Data

[63] Continuation of application No. PCT/EP95/04917, Dec. 13, 1995.

[30] Foreign Application Priority Data

Dec. 24, 1994 [DE] Germany ..... 44 46 528
Dec. 1, 1995 [DE] Germany ..... 195 44 887

[51] Int. Cl.[6] ..... C25C 3/06; C25C 15/08

[52] U.S. Cl. ..... 205/393

[58] Field of Search ..... 205/392, 393

[56] References Cited

U.S. PATENT DOCUMENTS 4,050,999 9/1977 Johnson ..... 205/393
4,525,181 6/1985 Böckman ..... 423/240 S X
4,576,690 3/1986 Fields et al. ..... 205/393 X

*Primary Examiner*—Donald R. Valentine
*Attorney, Agent, or Firm*—Herbert L. Lerner; Laurence A. Greenberg

[57] ABSTRACT

A method and a cleaning device for the mechanical cleaning of a powder, in particular of primary aluminum oxide, direct the powder against a surface in order to strip particulate impurities adhering to the surface of the powder. The aluminum oxide to be cleaned is introduced into a stripping device having a striking mechanism directing the powder with a speed of 20 to 30 m/s several tens of times per second for a time period of <1 to 10 seconds against impact blades rotating in a direction opposite to the striking mechanism The particles of the cleaned, powder-form aluminum oxide having a size of >10 μm are separated from the cleaned, powder-form aluminum oxide having a size <10 μm and the impurities by an air sifter and/or a cyclone and are fed for smelting electrolysis. The powder-form aluminum oxide having a size <10 μm and the impurities are fed to a waste dump or are further processed as raw material.

6 Claims, 4 Drawing Sheets

METHOD FOR CLEANING OF ALUMINUM OXIDE POWDERS

CROSS-REFERENCE TO RELATED APPLICATION

This application is a continuation of International Application Serial No. PCT/EP95/04917, filed Dec. 13, 1995.

BACKGROUND OF THE INVENTION

Field of the Invention

The invention relates to a method for the mechanical cleaning of a powder, in particular of primary aluminum oxide, which is directed against a surface in order to strip particulate impurities adhering to its surface. The invention also relates to a device for the mechanical cleaning of a powder by mechanical detachment of particulate impurities from the surface of the powder, in particular of primary aluminum oxide, having a stripping device, within which the powder can be directed against a surface.

Such a method is suitable for removing impurities which adhere to the surface of powder particles. Such methods are employed, for example, in the cleaning of powder-form aluminum oxide, which is intended for the production of aluminum. During aluminum production, the powder-form primary aluminum oxide is first used to clean flue gas produced during the smelting electrolysis. In that case the flue gas is directed past the primary aluminum oxide, and the particles, in the form of fluoride, iron, phosphorus, carbon, silicon, vanadium and nickel, which are evolved from the smelting electrolysis, adhere to the surface of the powder-form aluminum oxide. Before the aluminum oxide is fed to the smelting electrolysis, the impurities in the form of iron, phosphorus, carbon, silicon, nickel and vanadium must be removed, since otherwise the process would be enriched with them. That would have a detrimental effect on the quality of the aluminum and the efficiency of the process. The fluorine which is required for carrying out the smelting electrolysis must be collected and fed back to the process.

A method for the removal of impurities from the surface of powder-form particles is disclosed by Published French Patent Application 2,499,057, which is identical to Norwegian Patent 147,791 and corresponds to U.S. Pat. No. 4,525,181. In that method, an air stream which is loaded with the powder to be cleaned is directed against an impact plate. The effect of the impact is that the impurities adhering to the surface of the powder are detached. The impurities and the powder are then separated from each other by screening. That method is very expensive to control and furthermore has an excessively low efficiency in the case of a throughput of several tons per hour.

French Patent 7,732,072 discloses a method for the stripping of particulate impurities from the surface of powders. In that method, the powder to be cleaned is introduced into two crossed air jets. At a crossover point of those jets, the powder particles strike one another. In that case the particles rub on one another and the impurities adhering to the surface are detached. Since the stripped impurities are lighter than the powder particles, they can be removed with the aid of an air current, while the heavier powder particles fall downwards. That method is very difficult when it is used in a current large-scale process, since it is not constructed for the cleaning of large quantities of particles.

German Published, Non-Prosecuted Patent Application DE 16 07 465 A1, corresponding to UK Patent Application GB 1 199 303, discloses an impact crusher for crushing hard and medium-hardness material. The impact crusher is formed of a housing with impact plates which are disposed opposite beater arms of a rotor. The housing furthermore has a delivery guide for feeding the material, as well as an output opening. The impact plate is disposed below the delivery guide and has a roof-shaped construction. The impact plate has a width from place to place which is greater than half a diameter of the rotor.

U.S. Pat. No. 4,361,290 describes a rotating beater mill with which material can be reduced to three different sizes and separated. The beater mill is provided with a rotor, the arms of which have plates for reducing material fastened to them.

Published European Patent Application 0 337 137, corresponding to U.S. Pat. Nos. 5,058,815 and 5,215,269, discloses a hammer mill for reducing the size of ore and similar materials. The device is bounded by a cylindrical housing. Impact plates and a rotor are disposed inside the housing and a plurality of hammers is fastened to the impact plates at a defined mutual separation and is used for reducing the size of the ore or for projecting the ore against the impact plates.

SUMMARY OF THE INVENTION

It is accordingly an object of the invention to provide a method and a device for the cleaning of powders, which overcome the hereinafore-mentioned disadvantages of the heretofore-known methods and devices of this general type and with which it is possible to strip impurities adhering to the surface of powders cost-effectively and with a higher efficiency than heretofore.

With the foregoing and other objects in view there is provided, in accordance with the invention, a method for the mechanical cleaning of a powder, in particular a primary aluminum oxide powder, which comprises introducing aluminum oxide, to be cleaned or stripped of particulate impurities adhering to a surface of the aluminum oxide, into a stripping device having a striking mechanism rotating in a given direction; directing the aluminum oxide with the striking mechanism at a speed of 20 to 30 m/s several tens of times per second for a time period of <1 to 10 seconds against a surface in the form of impact blades rotating in a direction opposite the given direction; separating the particles of the cleaned, powder-form aluminum oxide having a size of >10 $\mu$m from the cleaned, powder-form aluminum oxide having a size <10 $\mu$m and the impurities with a sifter and/or a cyclone; feeding the particles of the cleaned, powder-form aluminum oxide having a size of >10 $\mu$m for smelting electrolysis; and feeding the powder-form aluminum oxide having a size <10 $\mu$m and the impurities to a waste dump or for further processing as raw material.

With the objects of the invention in view there is also provided a cleaning device for the mechanical detachment of particulate impurities from a surface of a powder, in particular of primary aluminum oxide, comprising a stripping device constructed as an impact mill having impact blades rotating in a given direction, and at least one striking mechanism rotating in a direction opposite the given direction for directing a powder to be cleaned against a surface in the form of the impact blades at a defined speed, the striking mechanism and the impact blades being made of a material selected from the group consisting of a hard metal, a ceramic and a polymer; and an air sifter and/or a cyclone connected downstream of the stripping device.

When the method according to the invention is carried out, the powder to be cleaned passes through a mechanically operating cleaning device. In one embodiment of the invention, this device includes a stripping device, downstream of which a cyclone and/or an air sifter are connected. The construction and mode of operation of the stripping device correspond to those of an impact crusher. In this device, the powder is directed, by a rotor or a striking mechanism, with a predetermined speed against impact blades which rotate in the opposite direction to the striking mechanism. Through the use of the rotational speed of the rotor or of the striking mechanism and a fixed dwell time of the powder in the stripping device, it is possible to control the impact speed of the powder and the number of impacts of the powder on the plates. The impact speed is less than 120 m/s. It is preferably set at 20 to 40 m/s. The setting of the impact speed is particularly important, since it is only in this way that it is possible to achieve the effect of all of the impurities being removed from the surface of the powder, but without the powder being broken down. After the cleaned powder and the impurities detached therefrom have been withdrawn from the stripping device, the cleaned powder having a particle size of >10 $\mu$m is separated from powder having a particle size of <10 $\mu$m and the impurities, which are likewise no larger than 10 $\mu$m. This is done, for example, with the aid of a cyclone and/or an air sifter, which are connected downstream of the stripping device. Air sifters are very expensive to produce. Costs can be saved by connecting the air sifter downstream of the cyclone. This has the advantage of causing a fraction of the powder having a particle size of >20 to 30 $\mu$m to already be stripped in the cyclone. It is therefore possible to use a smaller air sifter. In favorable cases it is also sufficient to connect only a cyclone after the stripping device.

In a simplified embodiment of the cleaning device, the impact crusher and a cyclone are not employed. The cleaning device is formed only of an air sifter. In this case, however, the air sifter must be constructed in such a way that the air routing in its interior causes a disintegration effect. The air sifter must be built in such a way that the powder to be cleaned is directed with the above-described speed against one or more surfaces, so that the impurities adhering to the powder are stripped. The advantage of using only an air sifter for the powder cleaning is that separation of the cleaned powder can be carried out simultaneously therewith.

All of the above-described cleaning devices are constructed in such a way that it is possible to separate the cleaned powder according to size so that the powder having a particle size of >10 $\mu$m is fed to the smelting electrolysis for the production of aluminum. The powder having a particle size <10 $\mu$m, and the impurities, are stored in a waste dump or further processed as raw material. Using the method according to the invention, it is possible to remove at least 25% of the iron, more than 50% of the phosphorus and 25% of the carbon, which adheres as impurity to the powder-form aluminum oxide. Using this method it is also possible to recycle 60% of the fluorine into the smelting electrolysis. The quantity of stripped impurities, and the quantity of fluorine which can be recovered using the method according to the invention, represent a significant improvement over the results which are obtained by using known methods. Since vanadium and nickel adhere to iron, vanadium and nickel are also isolated from the smelting-electrolysis flue gas in accordance with the stripped quantity of iron.

Other features which are considered as characteristic for the invention are set forth in the appended claims.

Although the invention is illustrated and described herein as embodied in a method and a device for the cleaning of powders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
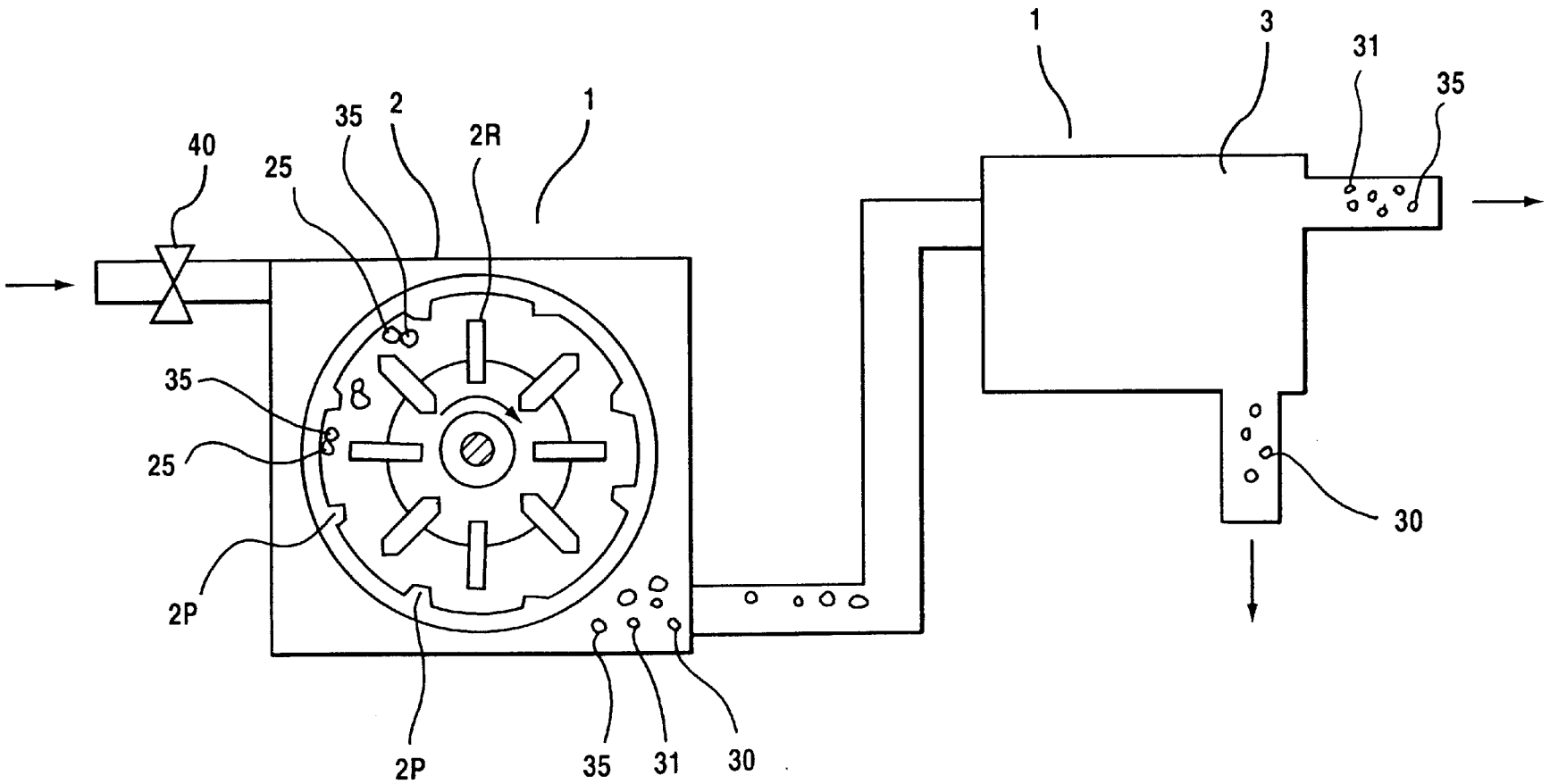
FIG. 1 is a diagrammatic, elevational view of a cleaning device according to the invention.

Referring now to the figures of the drawings in detail and first, particularly, to FIG. 1 thereof, there is seen a cleaning device 1 for the mechanical detachment of impurities 35 adhering to the surface of a powder 25. This cleaning device has a stripping device 2 and an air sifter 3. As can be seen from the figure, the air sifter 3 is connected directly downstream of the stripping device 2. The stripping device 2 is essentially constructed in the manner of an impact crusher. The stripping device 2 has at least one rotor or striking mechanism 2R, with the aid of which the powder 25 introduced into the stripping device 2 is directed against stationary impact plates or impact blades 2P rotating in the opposite direction to the striking mechanism. The cleaning device 1 represented herein is intended for the cleaning of powder-form primary aluminum oxide, which is represented by the powder 25. However, it is also possible to use the cleaning device to clean other powders. The striking mechanism 2R and the impact plates or blades are made of materials which are particularly suitable for such a treatment of powder-form aluminum oxide. Preferably, those components of the stripping device 2 which come into contact with the aluminum oxide 25 are made of a hard metal, a ceramic or a polymer having corresponding properties. The impurities 35 adhering to the surface of the powder 25 are detached with the aid of the cleaning device 1. These are particles having a size of <10 $\mu$m. In the primary aluminum oxide 25, the impurities are formed essentially of fluorine, iron, phosphorus, carbon, silicon, nickel and vanadium.

The powder-form primary aluminum oxide 25 is first used for cleaning flue gas evolved by smelting-electrolysis. It is then itself cleaned and fed to the smelting electrolysis for the production of aluminum. Cleaning of the flue gas involves taking up or accumulation of the above-described impurities. It is necessary to clean the aluminum oxide 25 so that the smelting electrolysis is not enriched with these impurities. If this cleaning is not carried out, then the phosphorus and vanadium lead to a decrease in the current efficiency during the smelting electrolysis. That means that the overall efficiency of the process decreases. The quality of the aluminum is impaired by the iron and the silicon.

The powder-form primary aluminum oxide 25 is introduced into the stripping device 2 through a metering device 40. The throughput of the stripping device 2 shown herein is chosen to be high enough for it to be possible to clean approximately 20 tons of aluminum oxide 25 per hour. The powder-form aluminum oxide 25 is introduced automatically. In this case the speed of rotation of the striking mechanism 2R is set in such a way that the aluminum oxide 25 strikes the impact plates or blades 2P with a speed of 20 to 30 m/s. The impurities 35 adhering to the surface of the powder-form aluminum oxide 25 are stripped in the process.

Approximately 50% of the aluminum oxide 25 to be cleaned has a particle size of 50 μm. The remaining aluminum oxide 25 has a larger particle size. The speed with which the aluminum oxide 25 is directed against the impact blades or plates 2P is just large enough for the impurities 35 to be stripped, but without the powder-form aluminum oxide 25 being broken down. After the aluminum oxide has been directed at least a few tens of times per second with a speed of 20 to 30 m/s onto the impact plates or blades, it is removed, together with the stripped impurities 35, from the stripping device 2 and fed to the air sifter 3. Both take place automatically in turn. The impurities 35, which are <10 μm, and aluminum oxide 31 having the same particle size, are diverted off to one side with the aid of an air current, as is shown in FIG. 1. Cleaned powder-form aluminum oxide 30, which has a particle size of >10 μm, is diverted downwards out of the air sifter 3 under the effect of gravity, and fed to the non-illustrated smelting electrolysis.

Figure 2:
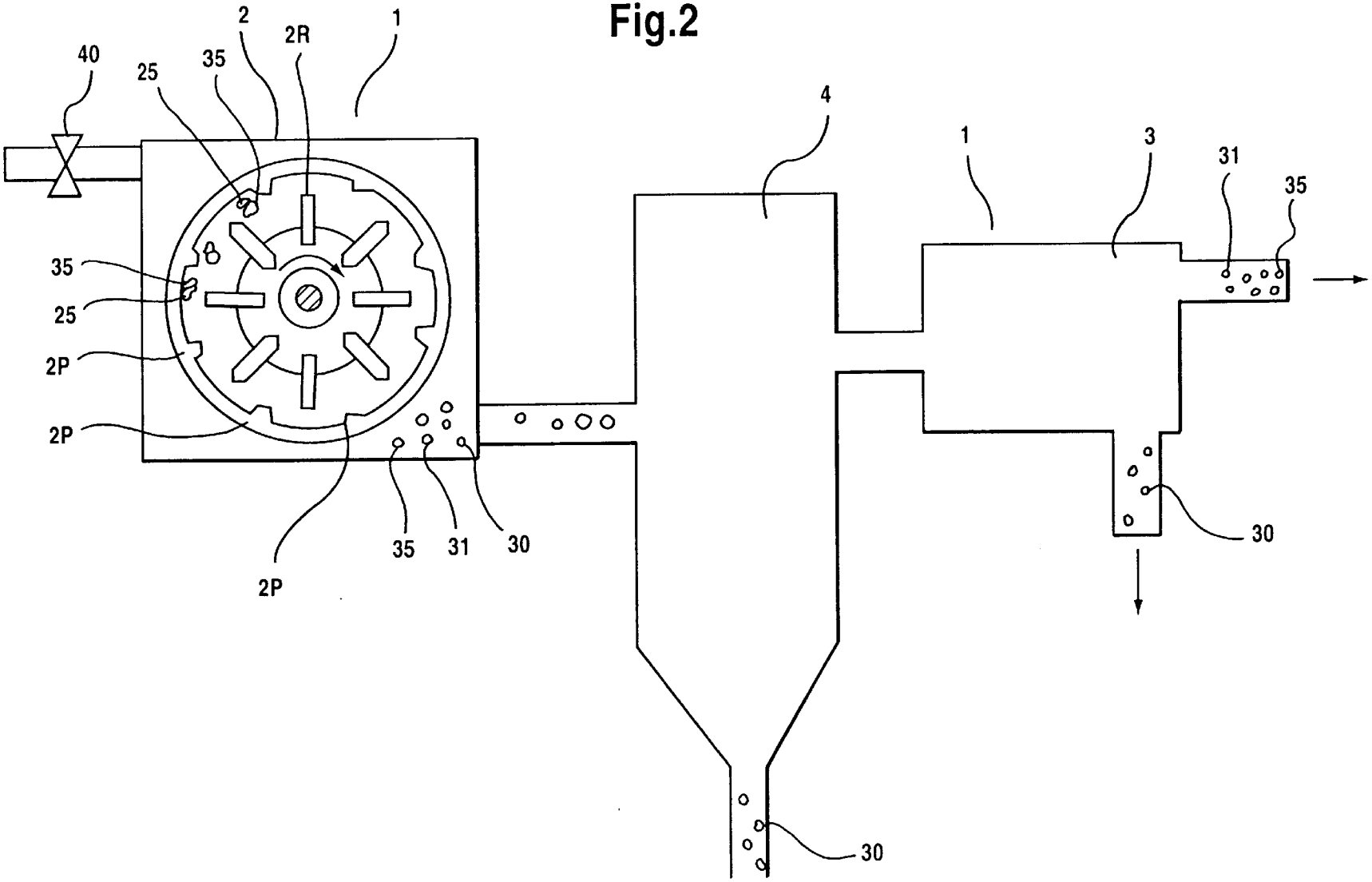
FIG. 2 is a view similar to FIG. 2 of a variant of the cleaning device represented in FIG. 1.

In the case of the cleaning device 1 shown in FIG. 2, which is essentially the same in structure as the cleaning device 1 according to FIG. 1, a cyclone 4 is connected between the stripping device 2 and the air sifter 3. Cleaned aluminum oxide particles having a size of more than 20 μm to 30 μm are isolated by the cyclone 4 and fed to the smelting electrolysis. The remaining powder, having a particle size <20 to 30 μm, is fed to the air sifter for further separation. In contrast to the cleaning device 1 according to FIG. 1, this cleaning device 1 has the advantage of permitting a substantially smaller air sifter 3 to be used, since the fraction of the cleaned aluminum oxide having particles which are larger than 20 to 30 μm is already fed out from the cyclone 4 directly back to the smelting electrolysis. Since 50% of the cleaned aluminum oxide is larger than 50 μm, the amount of powder to be further treated in the air sifter 3 is greatly reduced by the intermediate connection of the cyclone 4.

Figure 3:
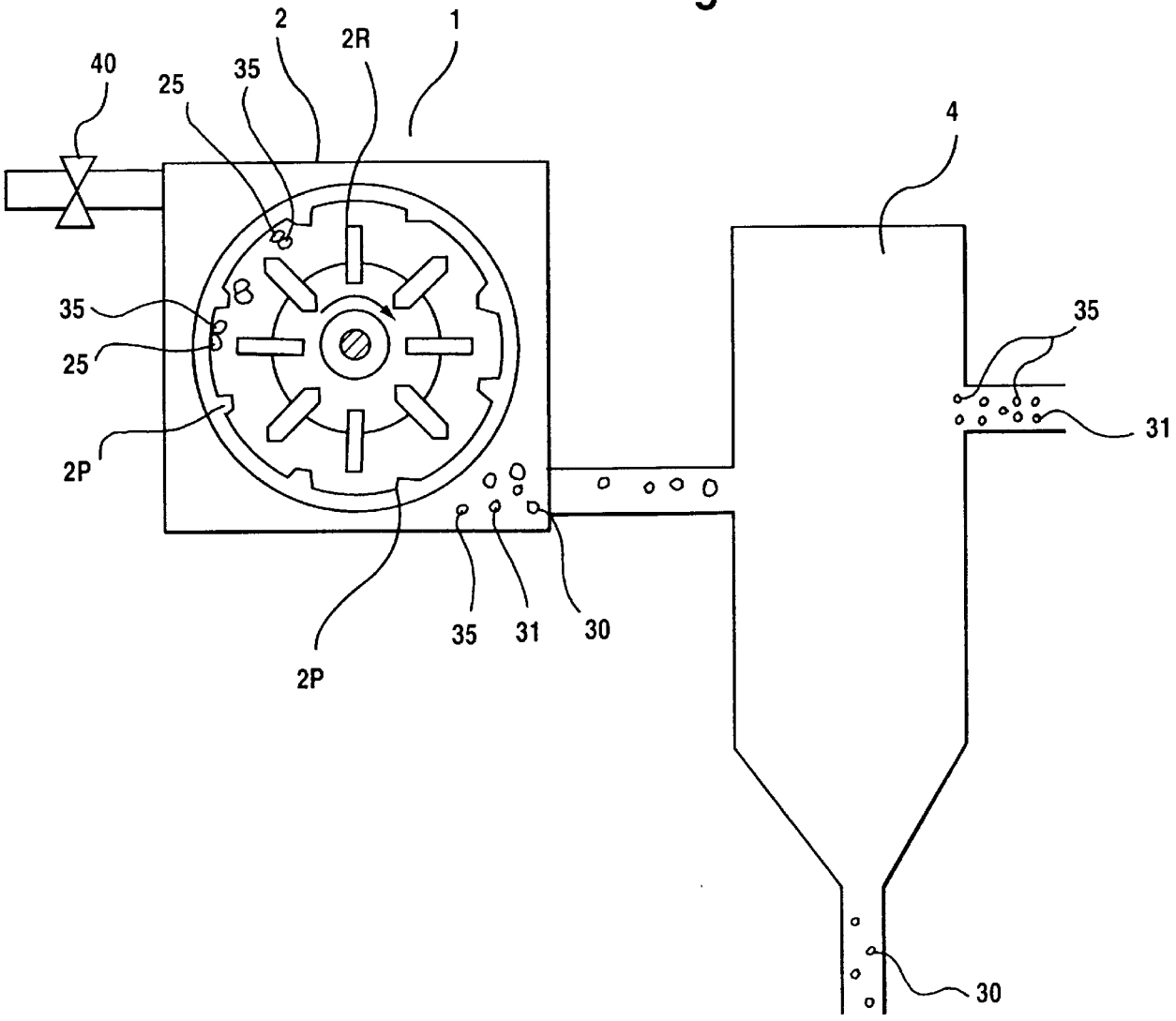
FIG. 3 is a view similar to FIG. 2 of a simplified embodiment of the cleaning device.

FIG. 3 shows a cleaning device 1 which is essentially the same in structure as the cleaning device 1 according to FIG. 1. In this case, only a cyclone 4 is connected downstream of the stripping device 2. It is suitable to use this cleaning device 1 whenever stripping of particles <16 μm is sufficient.

Figure 4:
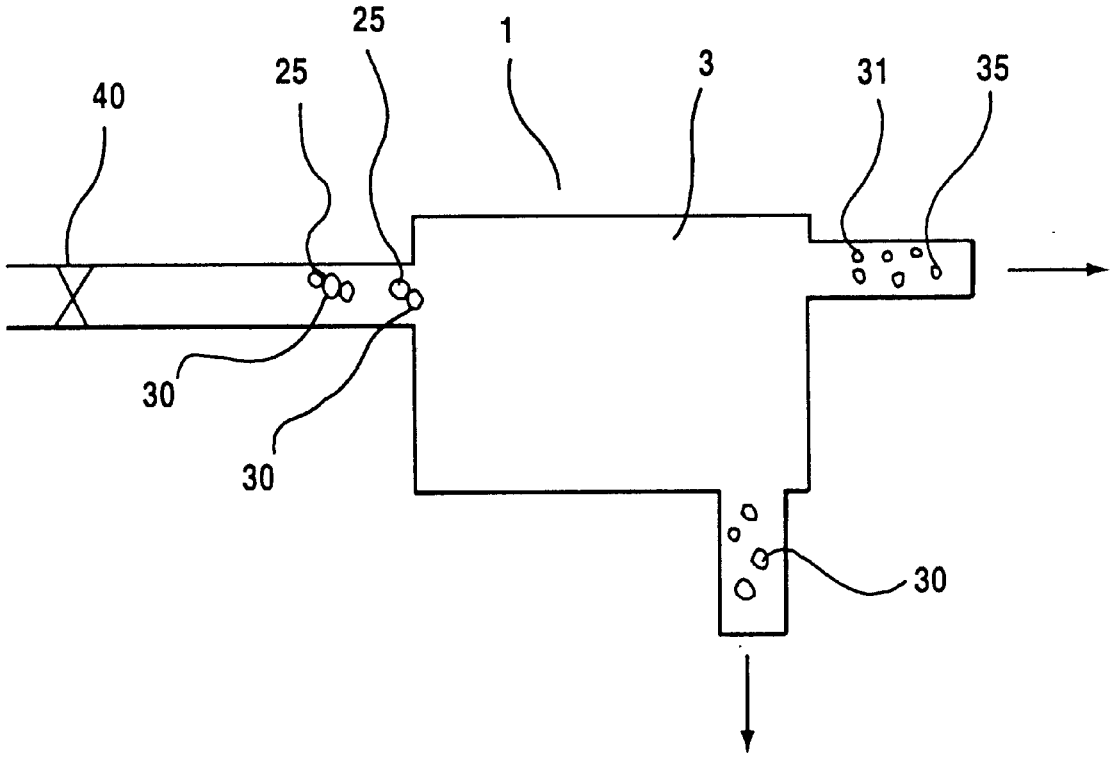
FIG. 4 is an elevational view of an air sifter as a stripping and separating device.

In a further embodiment according to FIG. 4, only an air sifter 3 is provided for stripping the impurities 35 from the powder 25 and for separating the powder according to size. The powder 25 to be cleaned is likewise fed to this sifter through a metering device 40. In this case use is made of an air sifter 3 which has a non-illustrated disintegration zone. This zone makes it possible to feed the powder 25 to be cleaned with the required speed of 20 to 30 m/s against at least one non-illustrated surface, so that the impurities can be stripped. It is possible to subsequently carry out separation of the powder according to particle sizes by using this air sifter 3. Separation down to a particle size <8 μm is thereby possible.

With the above-described devices it is possible to remove at least 25% of the iron, more than 50% of the phosphorus and 25% of the carbon, which adheres as impurities 35 to the powder-form aluminum oxide 25. It is also possible to recycle 60% of the fluorine into the smelting electrolysis by using this method. The amount of stripped impurities 35 and the amount of fluorine which can be recovered by using the method according to the invention represent a significant improvement over the results which are obtained with known methods.

We claim:

1. A method for the mechanical cleaning of an aluminum oxide powder, which comprises:

introducing aluminum oxide, to be cleaned of particulate impurities adhering to a surface of the aluminum oxide, into a stripping device having a striking mechanism rotating in a given direction;

directing the aluminum oxide with the striking mechanism at a speed of 20 to 30 m/s several tens of times per second for a time period of <1 to 10 seconds against impact blades rotating in a direction opposite the given direction;

separating particles of cleaned, powder-form aluminum oxide having a size of >10 μm from the cleaned, powder-form aluminum oxide having a size <10 μm and the impurities;

feeding the particles of the cleaned, powder-form aluminum oxide having a size of >10 μm into a smelting electrolysis press; and removing the powder-form aluminum oxide having a size <10 μm and the impurities.

2. The method according to claim 1, which comprises carrying out the separating step with an air sifter and a cyclone.

3. The method according to claim 1, which comprises carrying out the separating step with an air sifter.

4. The method according to claim 1, which comprises carrying out the separating step with a cyclone.

5. The method according to claim 1, which comprises carrying out the removing step by feeding to a waste dump.

6. The method according to claim 1, which comprises carrying out the removing step by further processing the powder-form aluminum oxide having a size <10 μm and the impurities as raw material to be recycled.

* * * * *